US012693053B2

(12) United States Patent
Novak et al.

(10) Patent No.: US 12,693,053 B2
(45) Date of Patent: Jul. 28, 2026

(54) LUBRICANT MANAGEMENT IN AN HVACR SYSTEM

(71) Applicant: TRANE INTERNATIONAL INC., Davidson, NC (US)

(72) Inventors: Keith Adam Novak, Holmen, WI (US); Gordon Powell, Jr., Stoddard, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 177 days.

(21) Appl. No.: 16/888,081

(22) Filed: May 29, 2020

(65) Prior Publication Data

US 2020/0378659 A1 Dec. 3, 2020

Related U.S. Application Data

(63) Continuation-in-part of application No. 16/427,827, filed on May 31, 2019.

(51) Int. Cl.
*F25B 31/00* (2006.01)
*F25B 1/047* (2006.01)

(52) U.S. Cl.
CPC ..... *F25B 31/004* (2013.01); *F25B 1/047* (2013.01)

(58) Field of Classification Search
CPC .... F25B 1/047; F25B 2500/16; F25B 31/002; F25B 31/004; F04C 29/02; F04C 29/042; F04C 18/16; F04C 18/123; F04C 18/126; F04C 2240/14
See application file for complete search history.

(56) References Cited

U.S. PATENT DOCUMENTS 4,335,582 A 6/1982 Shaw et al.
4,439,121 A * 3/1984 Shaw ..... F04C 29/02 418/98
4,478,054 A 10/1984 Shaw et al.
4,875,835 A * 10/1989 Nakajima ..... F04C 29/02 417/310
5,027,606 A 7/1991 Short
5,761,914 A 6/1998 Carey et al.
6,116,046 A 9/2000 Leaver et al.
6,170,286 B1 * 1/2001 Keuper ..... F25B 31/004 62/84
2003/0173155 A1 9/2003 Picouet
2005/0257542 A1 11/2005 von Borstel
(Continued)

FOREIGN PATENT DOCUMENTS

JP 4174076 B2 10/2008

OTHER PUBLICATIONS

Pool 3. (2012). In Merriam-Webster's Collegiate(R) Dictionary. Merriam-Webster. Retrieved Sep. 30, 2023, from https://search.credoreference.com/articles/Qm9va0FydGljbGU6Mj|4Mzcx.*
(Continued)

*Primary Examiner* — Tavia Sullens
(74) *Attorney, Agent, or Firm* — HSML P.C.

(57) ABSTRACT

A heating, ventilation, air conditioning, and refrigeration (HVACR) system is disclosed. The HVACR system includes a compressor, a condenser, and an evaporator fluidly connected to form a refrigerant circuit. A lubricant return line is fluidly connected to the compressor and to the evaporator. A pressure difference between the compressor and the evaporator induces a fluid flow of lubricant from the evaporator to the compressor.

11 Claims, 6 Drawing Sheets

(56) References Cited

U.S. PATENT DOCUMENTS

| | | | | |
|---|---|---|---|---|
| 2011/0014079 | A1 | 1/2011 | Pauwels et al. | |
| 2012/0017634 | A1 | 1/2012 | Dorman et al. | |
| 2012/0207634 | A1 | 8/2012 | Heger et al. | |
| 2013/0209299 | A1 | 8/2013 | Santos et al. | |
| 2015/0226218 | A1* | 8/2015 | Yonemoto ..... | F04C 29/02 418/92 |
| 2016/0069598 | A1 | 3/2016 | Lv et al. | |
| 2018/0073785 | A1 | 3/2018 | Jonsson et al. | |
| 2018/0128523 | A1 | 5/2018 | Hauleitner et al. | |
| 2018/0128524 | A1 | 5/2018 | Hauleitner et al. | |

OTHER PUBLICATIONS

Office Action issued in U.S. Appl. No. 16/427,827, mailed Mar. 29, 2022 (24 pages).
Office Action, U.S. Appl. No. 16/427,827, filed May 11, 2021 (20 pages).
Examiner Interview Summary, U.S. Appl. No. 16/427,827, filed Jul. 15, 2021 (7 pages).
Final Office Action issued in U.S. Appl. No. 16/427,827, mailed Oct. 14, 2022 (22 pages).
Wennermar, "Dry Screw Compressor Perfomance and Application Range", in Proceedings of the Thirty-Eighth Turbomachinery Symposium, pp. 149-156 (2009).
Office Action issued in U.S. Appl. No. 16/427,827, filed Aug. 24, 2023 (25 pages).

* cited by examiner

LUBRICANT MANAGEMENT IN AN HVACR SYSTEM

FIELD

This disclosure relates generally to a heating, ventilation, air conditioning, and refrigeration (HVACR) system. More specifically, this disclosure relates to lubricant management for a compressor in an HVACR system.

BACKGROUND

A heating, ventilation, air conditioning, and refrigeration (HVACR) system generally includes a compressor. Compressors, such as, but not limited to, screw compressors and scroll compressors, utilize bearings to support a rotating shaft. The bearings generally include a lubricant system. If the bearings are not properly lubricated, the bearings, and ultimately the compressor, may fail prior to an expected lifetime of the bearing.

SUMMARY

This disclosure relates generally to a heating, ventilation, air conditioning, and refrigeration (HVACR) system. More specifically, this disclosure relates to lubricant management for a compressor in an HVACR system.

A heating, ventilation, air conditioning, and refrigeration (HVACR) system is disclosed. The HVACR system includes a compressor, a condenser, and an evaporator fluidly connected to form a refrigerant circuit. A lubricant return line is fluidly connected to the compressor and to the evaporator. A pressure difference between the compressor and the evaporator induces a fluid flow of lubricant from the evaporator to the compressor.

A lubricant management method for a compressor in a heating, ventilation, air conditioning, and refrigeration (HVACR) system is also disclosed. The method includes forming a lubricant inlet port in a location of a compressor of the HVACR system. The location is disposed between a suction inlet and a discharge outlet of the compressor. The method further includes fluidly connecting the lubricant inlet port and an evaporator in the HVACR system. The lubricant inlet port can be formed in a trapped volume pocket of the compressor. In an embodiment, the trapped volume pocket can be a compression pocket or chamber. In an embodiment, the compressor is a screw compressor and the trapped volume pocket is a rotor pocket.

A compressor for a heating, ventilation, air conditioning, and refrigeration (HVACR) system is also disclosed. The compressor includes a suction inlet that receives a working fluid to be compressed. A compression mechanism is fluidly connected to the suction inlet that compresses the working fluid. A discharge outlet is fluidly connected to the compression mechanism that outputs the working fluid following compression by the compression mechanism. A lubricant inlet port is disposed between the suction inlet and the discharge outlet at a location that is relatively closer to the suction inlet than the discharge outlet. The lubricant inlet port is configured to be fluidly connected to an evaporator. A pressure difference between the compressor and the evaporator is configured to induce a fluid flow of lubricant from the evaporator to the compressor.

BRIEF DESCRIPTION OF THE DRAWINGS

References are made to the accompanying drawings that form a part of this disclosure, and which illustrate embodiments in which the systems and methods described in this specification can be practiced.

Like reference numbers represent like parts throughout.

DETAILED DESCRIPTION

This disclosure relates generally to a heating, ventilation, air conditioning, and refrigeration (HVACR) system. More specifically, this disclosure relates to lubricant management for a compressor in an HVACR system.

In an HVACR system, lubricant can pool in the evaporator. If the lubricant is not removed from the evaporator, the compressor and its components requiring lubrication may not receive a sufficient flow of lubricant. This can result in, for example, a forced shutdown to prevent catastrophic failures of the components of the compressor.

In some prior systems, the lubricant is removed from the evaporator by creation of a pressure drop across the compressor motor to enable flow between the evaporator and the compressor. However, the pressure drop causes a reduction in compressor performance. Another method includes using a pump or eductor to move the lubricant out of the evaporator. This method, however, increases a cost of the HVACR system by including additional components. The method also increases a complexity of the HVACR system to make the appropriate fluid connections. Both methods can additionally result in a decreased discharge superheat for the compressor. In some instances, an additional heat exchanger is included in the HVACR system to reduce the impact caused by the pump or eductor.

Embodiments of this disclosure are directed to systems and methods for removing lubricant from the evaporator and moving the lubricant to the compressor. The systems and methods of this disclosure can, for example, result in a simpler design and reduced cost relative to prior designs. The systems and methods of this disclosure can also move the lubricant from the evaporator to the compressor without reducing a performance of the HVACR system. In an embodiment, the systems and methods of this disclosure can result in an increased HVACR performance.

In an embodiment, a lubricant inlet port can be located in a trapped volume pocket during a suction phase of compression. In an embodiment, the trapped volume pocket can be a compression pocket or chamber. In an embodiment, the compressor can be a screw compressor and the trapped volume pocket can be a rotor pocket. As a volume of the rotor pocket expands, refrigerant is drawn into the rotor pocket. The pressure in the rotor pocket is relatively less than a saturated suction pressure in the evaporator, and results in suction of the lubricant from the evaporator toward the compressor.

Figure 1:
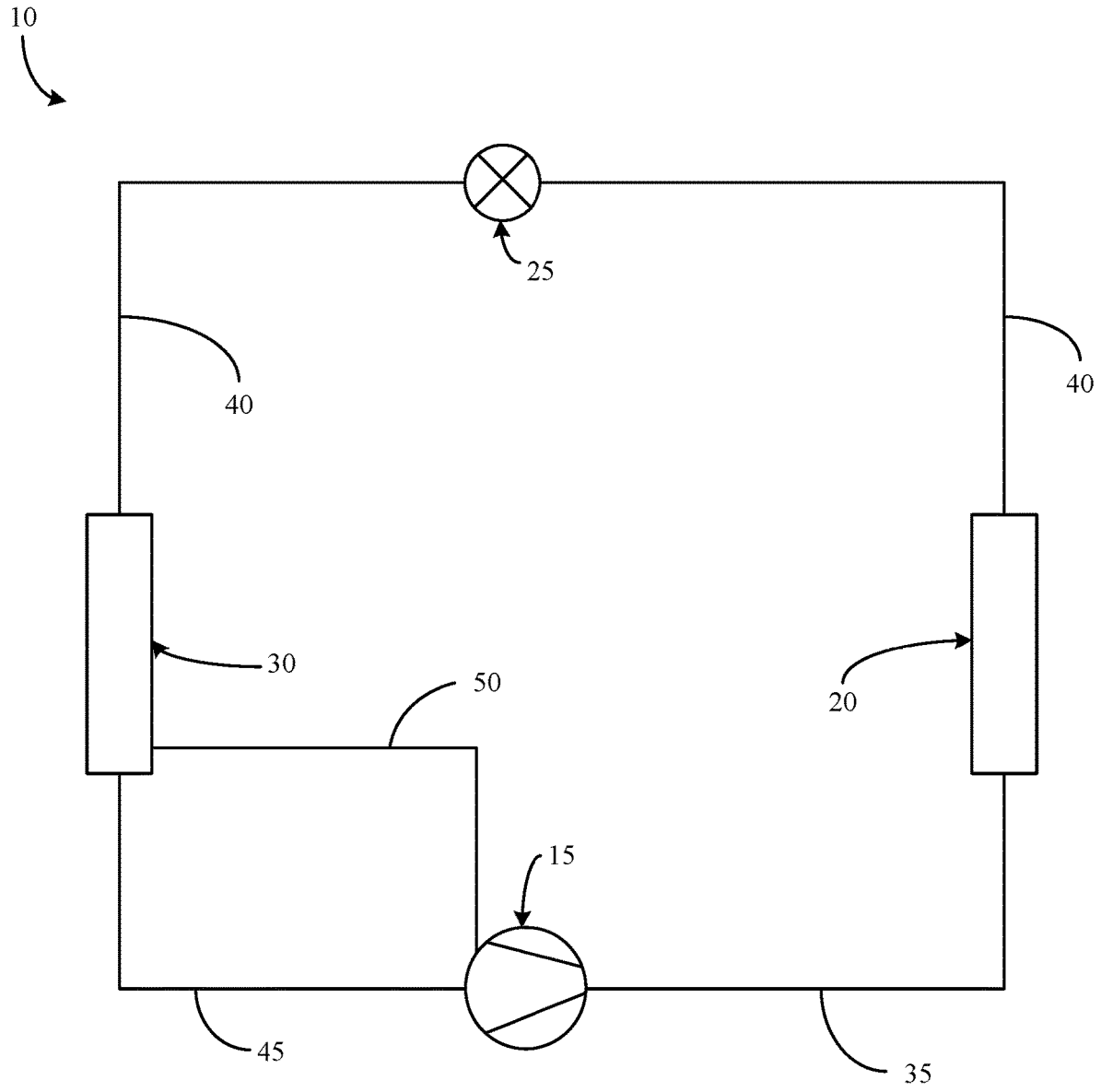
FIG. 1 is a schematic diagram of a refrigerant circuit, according to an embodiment.

FIG. 1 is a schematic diagram of a refrigerant circuit 10, according to an embodiment. The refrigerant circuit 10 generally includes a compressor 15, a condenser 20, an expansion device 25, and an evaporator 30.

The refrigerant circuit 10 is an example that is modifiable to include additional components. For example, in an embodiment, the refrigerant circuit 10 can include other components such as, but not limited to, an economizer heat exchanger, one or more flow control devices, a receiver tank, a dryer, a suction-liquid heat exchanger, or the like.

The refrigerant circuit 10 is generally applicable in a variety of systems used to control an environmental condition (e.g., temperature, humidity, air quality, or the like) in a space (generally referred to as a conditioned space). Examples of such systems include, but are not limited to, HVACR systems, transport refrigeration systems, or the like.

The refrigerant circuit 10 includes the compressor 15, condenser 20, expansion device 25, and evaporator 30 fluidly connected via refrigerant lines 35, 40, 45. In an embodiment, the refrigerant lines 35, 40, and 45 can alternatively be referred to as the refrigerant conduits 35, 40, and 45, or the like.

In an embodiment, the refrigerant circuit 10 is configured to be a cooling system (e.g., an air conditioning system) capable of operating in a cooling mode. In an embodiment, the refrigerant circuit 10 is configured to be a heat pump system that can operate in both a cooling mode and a heating/defrost mode.

The refrigerant circuit 10 can operate according to generally known principles. The refrigerant circuit 10 can be configured to heat or cool a gaseous process fluid (e.g., a heat transfer medium or fluid such as, but not limited to, air or the like), in which case the refrigerant circuit 10 may be generally representative of an air conditioner or heat pump.

In operation, the compressor 15 compresses a working fluid (e.g., a heat transfer fluid such as a refrigerant or the like) from a relatively lower pressure gas (e.g., suction pressure) to a relatively higher-pressure gas (e.g., discharge pressure). In an embodiment, the compressor 15 can be a positive displacement compressor. In an embodiment, the positive displacement compressor can be a screw compressor, a scroll compressor, a reciprocating compressor, or the like.

The relatively higher-pressure gas is also at a relatively higher temperature, which is discharged from the compressor 15 and flows through refrigerant line 35 to the condenser 20. The working fluid flows through the condenser 20 and rejects heat to a process fluid (e.g., water, air, or the like), thereby cooling the working fluid. The cooled working fluid, which is now in a liquid form, flows to the expansion device 25 via the refrigerant line 40. An "expansion device" may also be referred to as an expander. In an embodiment, the expander may be an expansion valve, expansion plate, expansion vessel, orifice, or the like, or other such types of expansion mechanisms. It is to be appreciated that the expander may be any type of expander used in the field for expanding a working fluid to cause the working fluid to decrease in temperature.

The expansion device 25 reduces the pressure of the working fluid. As a result, a portion of the working fluid is converted to a gaseous form. The working fluid, which is now in a mixed liquid and gaseous form flows to the evaporator 30 via the refrigerant line 40. The working fluid flows through the evaporator 30 and absorbs heat from a process fluid (e.g., water, air, or the like), heating the working fluid, and converting it to a gaseous form. The gaseous working fluid then returns to the compressor 15 via the refrigerant line 45. The above-described process continues while the refrigerant circuit is operating, for example, in a cooling mode (e.g., while the compressor 15 is enabled).

A lubricant is circulated along with the refrigerant. The lubricant can pool in the evaporator 30. If the lubricant is not removed from the evaporator 30, the compressor 15 and its components requiring lubrication may not receive a sufficient flow of lubricant. This can result in, for example, a forced shutdown to prevent catastrophic failures of the components of the compressor 15. A lubricant return line 50 is fluidly connected to the evaporator 30 and the compressor 15. The lubricant return line 50 can alternatively be referred to as the lubricant return conduit 50 or the like.

An inlet end of the lubricant return line 50 is connected at a location of the evaporator 30 at which liquid lubricant may pool. The lubricant return line 50 has an outlet end connected to a location of the compressor 15 having a relatively lower pressure than the evaporator 30. Thus the pressure differential between the inlet end and the outlet end of the lubricant return line 50 functions to pull the lubricant pooling in the evaporator 30 from the evaporator 30 to the compressor 15. As a result, the lubricant may not be trapped in the evaporator 30, which can, for example, reduce a likelihood of a forced shutdown or premature failure of the compressor 15. In an embodiment, the pressure drop between the evaporator 30 and the compressor 15 may be relatively small to induce the flow. For example, the pressure drop can be at or about 1 to at or about 2 psi. In an embodiment, the pressure drop can be at or about 1 psi or less than 1 psi. It is to be appreciated that these values are examples and can vary beyond the stated range. A location at which the outlet end of the lubricant return line 50 is disposed can vary, as discussed in further detail in accordance with the remaining figures below.

Figure 2:
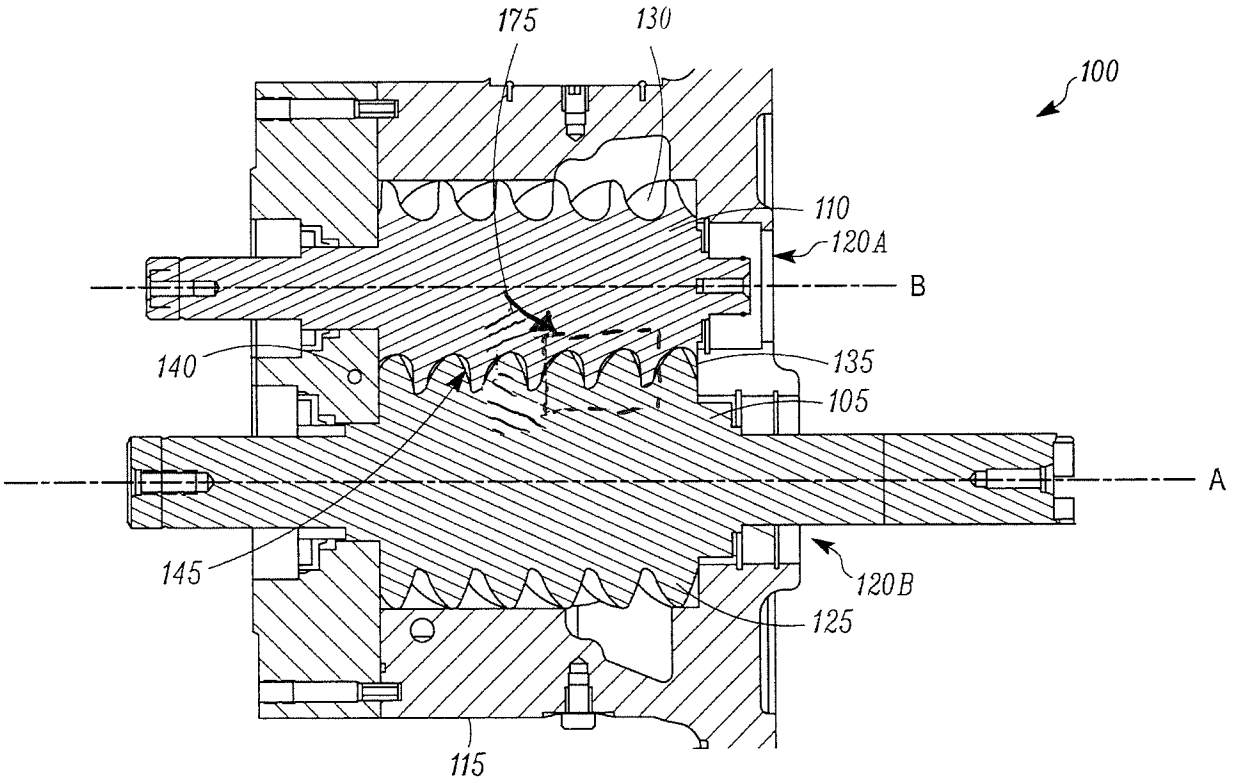
FIG. 2 is a screw compressor with which embodiments as disclosed in this Specification can be practiced, according to an embodiment.

FIG. 2 is a screw compressor 100 with which embodiments as disclosed in this Specification can be practiced, according to an embodiment. The screw compressor 100 can be used in the refrigerant circuit 10 of FIG. 1 (e.g., as the compressor 15).

The screw compressor 100 includes a first helical rotor 105 and a second helical rotor 110 disposed in a rotor housing 115. The rotor housing 115 includes a plurality of bores 120A and 120B. The plurality of bores 120A and 120B are configured to accept the first helical rotor 105 and the second helical rotor 110.

The first helical rotor 105, generally referred to as the male rotor, has a plurality of spiral lobes 125. The plurality of spiral lobes 125 of the first helical rotor 105 can be received by a plurality of spiral grooves 130 of the second helical rotor 110, generally referred to as the female rotor. In an embodiment, the spiral lobes 125 and the spiral grooves 130 can alternatively be referred to as the threads 125, 130. The first helical rotor 105 and the second helical rotor 110 are arranged within the housing 115 such that the spiral grooves 130 intermesh with the spiral lobes 125 of the first helical rotor 105.

During operation, the first and second helical rotors 105, 110 rotate counter to each other. That is, the first helical rotor 105 rotates about an axis A in a first direction while the second helical rotor 110 rotates about an axis B in a second direction that is opposite the first direction. Relative to an axial direction that is defined by the axis A of the first helical rotor 105, the screw compressor 100 includes an inlet port 135 and an outlet port 140.

The rotating first and second helical rotors 105, 110 can receive a working fluid (e.g., heat transfer fluid such as refrigerant or the like) at the inlet port 135. The working fluid can be compressed between the spiral lobes 125 and the spiral grooves 130 (in a trapped volume pocket 145 formed therebetween) and discharged at the outlet port 140. The trapped volume pocket may generally be referred to as the compression chamber 145 and is defined between the spiral lobes 125 and the spiral grooves 130 and an interior surface of the housing 115. In an embodiment, the compression chamber 145 may move from the inlet port 135 to the outlet port 140 when the first and second helical rotors 105, 110 rotate. In an embodiment, the compression chamber 145 may continuously reduce in volume while moving from the inlet port 135 to the outlet port 140. This continuous reduction in volume can compress the working fluid (e.g., heat transfer fluid such as refrigerant or the like) in the compression chamber 145.

The screw compressor 100 can include a lubricant inlet port 175. The lubricant inlet port 175 can, for example, provide an inlet flow path for lubricant that is fluidly connected to the evaporator 30 (FIG. 1). The lubricant inlet port 175 is fluidly connected to the outlet end of the lubricant return line 50 (FIG. 1) to receive the lubricant from the evaporator 30.

The lubricant inlet port 175 can, for example, be at a location of relatively lower pressure than the pressure of the lubricant in the evaporator 30 so as to induce flow of the lubricant from the evaporator 30 to the screw compressor 100. This can, for example, be a pressure drop of at or about 1 to at or about 2 psi. In an embodiment, the pressure drop and resulting fluid flow can prevent lubricant from collecting in the evaporator. In an embodiment, the lubricant inlet port 175 can be oriented radially with respect to the first and second helical rotors 105, 110. In an embodiment, the lubricant inlet port 175 can be oriented axially with respect to the first and second helical rotors 105, 110.

In an embodiment, the lubricant inlet port 175 can be included in the screw compressor 100 at a time of manufacturing.

Figure 3:
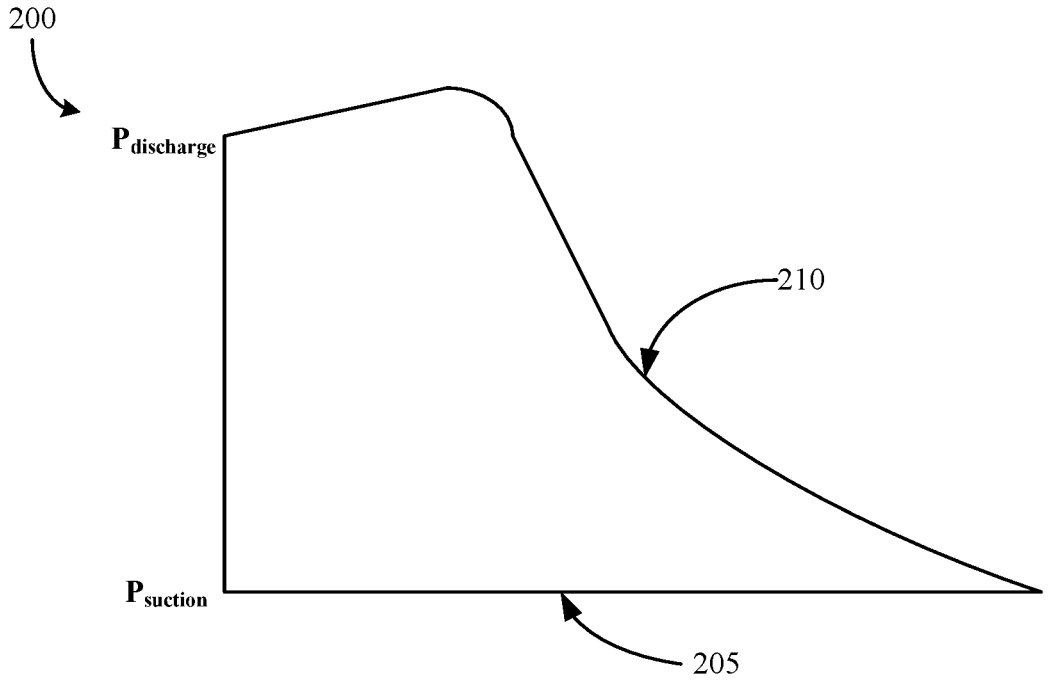
FIG. 3 is an ideal pressure-volume diagram for a compressor, according to an embodiment.

FIG. 3 is an ideal pressure-volume diagram 200 for a compressor, according to an embodiment. The pressure-volume diagram 200 is generally representative of an ideal pressure-volume diagram for the screw compressor 100 (FIG. 2). During a suction phase 205, volume of the working fluid (e.g., refrigerant or the like) expands. In the suction phase 205 of the ideal pressure-volume diagram, the pressure remains constant at suction pressure. During a compression phase 210, the volume of the working fluid decreases and the pressure of the working fluid increases from the suction pressure to a discharge pressure.

Figure 4:
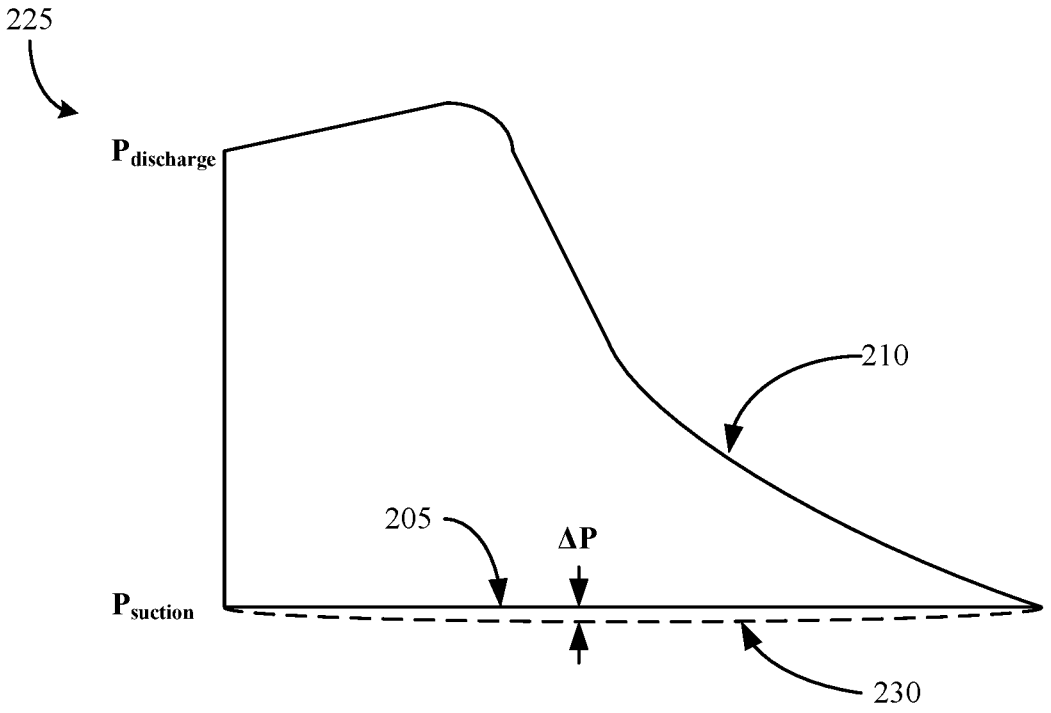
FIG. 4 shows a pressure-volume diagram for a compressor, according to an embodiment.

FIG. 4 shows a pressure-volume diagram 225 for a compressor (e.g., the compressor 100 of FIG. 2), according to an embodiment. The pressure-volume diagram 225 includes the suction phase 205 representative of the ideal pressure-volume relationship during the suction phase 205. The pressure-volume diagram 225 further shows dashed line 230 that is representative of the suction phase based on actual performance of the screw compressor 100 (as opposed to the ideal).

The dashed line 230 varies from the ideal pressure (e.g., below the suction pressure) by an amount ΔP. As shown, the pressure-volume diagram 225 differs from the pressure-volume diagram 200 that is representative of the ideal condition. Specifically, as illustrated, the line 230 is indicative of a condition in which the pressure of the working fluid in the suction phase 205 drops relatively lower than the suction pressure. This is a result of, for example, the compression mechanism (e.g., rotors in a screw compressor, scrolls in a scroll compressor, etc.) drawing in the working fluid for compression.

In an embodiment, the pressure of the working fluid may drop below the suction pressure by at or about 0.6 psi, thus ΔP is at or about 0.6 psi. It is to be appreciated that the ΔP is an example and is not intended to be limiting. The actual pressure drop value will be ΔP plus a pressure differential between the evaporator 30 and the screw compressor 100. In an embodiment, the pressure drop creates a sufficient pressure difference to pull lubricant from the evaporator 30 to the screw compressor 100 without impacting performance of the screw compressor 100. The actual pressure drop value can be impacted by various factors within a particular system. For example, the evaporator design, the compressor design, the conduit fluidly connecting the evaporator and the compressor, or other designs of the hardware, including but not limited to sizing, geometry, and the like. Lubricant type and additives, which may be used therewith, may also impact the actual pressure drop value. In an embodiment, the pressure drop may cause some decrease in performance of the screw compressor, but the decrease may be relatively less impactful than current designs. In an embodiment, it may be desirable to maintain the pressure drop as low as possible while still inducing lubricant flow.

Figure 5:
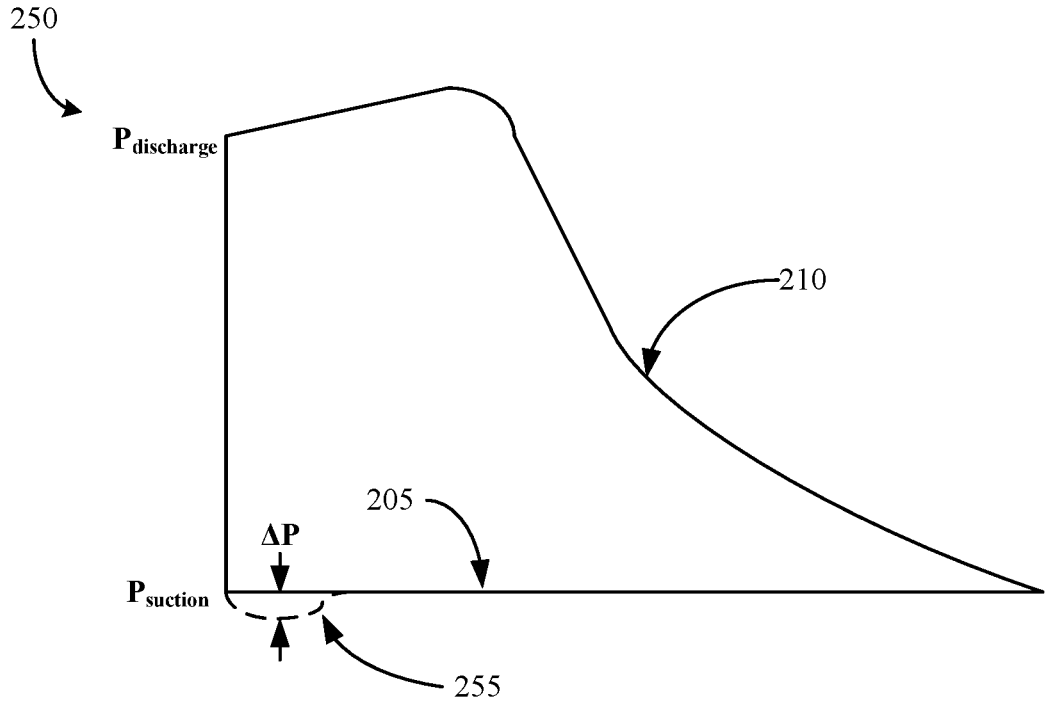
FIG. 5 shows a pressure-volume diagram for a compressor, according to another embodiment.

FIG. 5 shows a pressure-volume diagram 250 for a compressor (e.g., compressor 350 of FIG. 7), according to another embodiment. The pressure-volume diagram 250 includes the suction phase 205 representative of the ideal pressure-volume relationship during the suction phase 205. The pressure-volume diagram 250 further shows dashed line 255 that is representative of the suction phase based on actual performance of the screw compressor 400 (as opposed to the ideal).

As shown, the pressure-volume diagram 250 differs from the pressure-volume diagram 200 that is representative of the ideal condition. Specifically, as illustrated, the line 255 is indicative of a condition in which the pressure of the working fluid in the suction phase 205 drops relatively lower than the suction pressure. This is a result of, for example, the compression mechanism (e.g., rotors in a screw compressor, scrolls in a scroll compressor, etc.) drawing in the working fluid for compression. In the pressure-volume diagram 250 according to FIG. 5, the pressure drop shown by line 255 below the ideal condition is for a shorter period of the suction phase 205 than the pressure drop shown by line 230 in FIG. 4. The dashed line 255 varies from the ideal pressure (e.g., below the suction pressure) by the amount ΔP. In the embodiment of FIG. 5, ΔP occurs at a beginning of the suction phase and then approaches the ideal condition from FIG. 3.

In an embodiment, the pressure of the working fluid may be lower than the suction pressure. It is to be appreciated that the ΔP is an example and is not intended to be limiting. The actual pressure drop value will be ΔP plus a pressure differential between the evaporator 30 and the screw compressor 100. In an embodiment, the pressure drop creates a sufficient pressure difference to pull lubricant from the evaporator 30 to the screw compressor 100 without impacting performance of the screw compressor 100. The actual pressure drop value can be impacted by various factors within a particular system. For example, the evaporator design, the compressor design, the conduit fluidly connecting the evaporator and the compressor, or other designs of the hardware, including but not limited to sizing, geometry, and the like. Lubricant type and additives, which may be used therewith, may also impact the actual pressure drop value. In an embodiment, the pressure drop may cause some decrease in performance of the screw compressor, but the decrease may be relatively less impactful than current designs. In an embodiment, it may be desirable to maintain the pressure drop as low as possible while still inducing lubricant flow.

Figure 6:
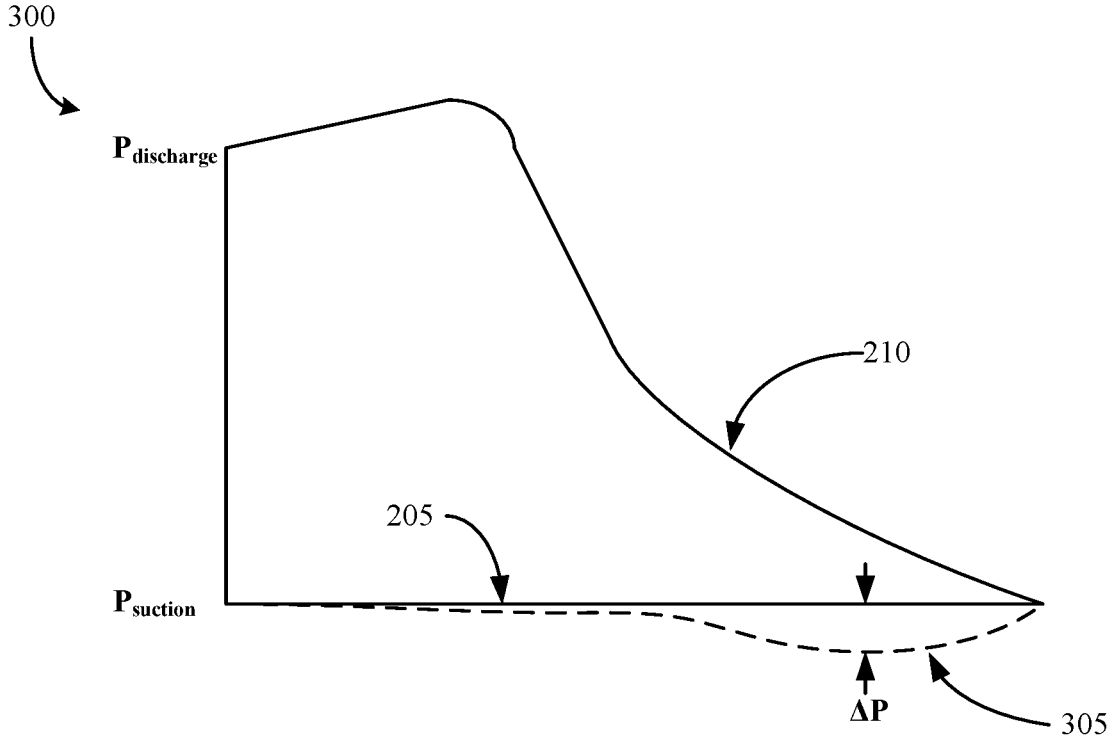
FIG. 6 shows a pressure-volume diagram for a compressor, according to another embodiment.

FIG. 6 shows a pressure-volume diagram 300 for a compressor (e.g., the compressor 100 of FIG. 2), according to another embodiment. The pressure-volume diagram 300 includes the suction phase 205 representative of the ideal pressure-volume relationship during the suction phase 205. The pressure-volume diagram 300 further shows dashed line 305 that is representative of the suction phase based on actual performance of the screw compressor 450 (as opposed to the ideal).

As shown, the pressure-volume diagram 300 differs from the pressure-volume diagram 200 that is representative of the ideal condition. Specifically, as illustrated, the line 305 is indicative of a condition in which the pressure of the working fluid in the suction phase 205 drops relatively lower than the suction pressure. This is a result of, for example, the compression mechanism (e.g., rotors in a screw compressor, scrolls in a scroll compressor, etc.) drawing in the working fluid for compression. In the pressure-volume diagram 300 according to FIG. 6, the pressure drop shown by line 305 below the ideal condition is for a shorter period of the suction phase 205 than the pressure drop shown by line 230 in FIG. 4. The dashed line 305 varies from the ideal pressure (e.g., below the suction pressure) by the amount ΔP. In the embodiment of FIG. 6, ΔP occurs at an end of the suction phase. To accomplish the pressure drop in FIG. 6, an adjustment to the rotor helix (e.g., a modification to the geometry of the rotors themselves) can be made such that the helix is delayed relative to the standard helix location.

In an embodiment, the pressure of the working fluid may be lower than the suction pressure. It is to be appreciated that the ΔP is an example and is not intended to be limiting. The actual pressure drop value will be ΔP plus a pressure differential between the evaporator 30 and the screw compressor 100. In an embodiment, the pressure drop creates a sufficient pressure difference to pull lubricant from the evaporator 30 to the screw compressor 100 without impacting performance of the screw compressor 100. The actual pressure drop value can be impacted by various factors within a particular system. For example, the evaporator design, the compressor design, the conduit fluidly connecting the evaporator and the compressor, or other designs of the hardware, including but not limited to sizing, geometry, and the like. Lubricant type and additives, which may be used therewith, may also impact the actual pressure drop value. In an embodiment, the pressure drop may cause some decrease in performance of the screw compressor, but the decrease may be relatively less impactful than current designs. In an embodiment, it may be desirable to maintain the pressure drop as low as possible while still inducing lubricant flow.

Figure 7:
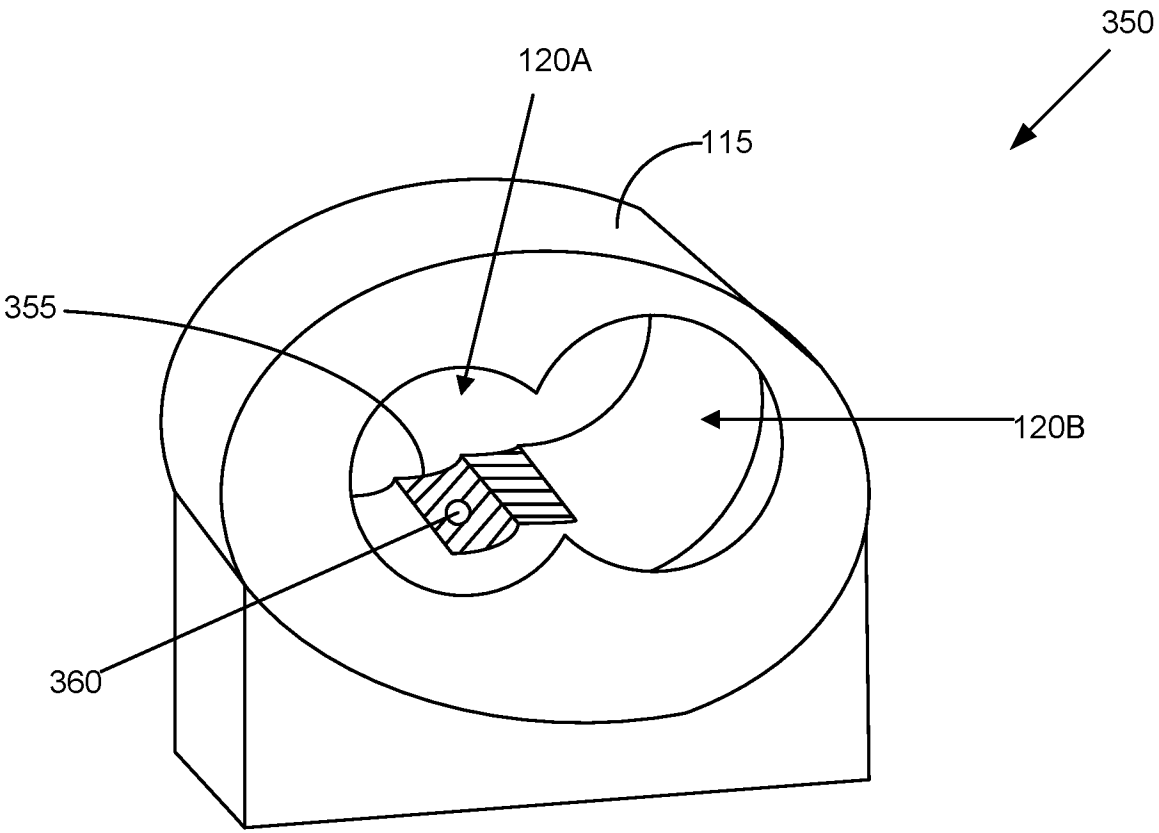
FIG. 7 shows a portion of a screw compressor, according to an embodiment.

FIG. 7 shows a portion of a screw compressor 350, according to an embodiment. The screw compressor 350 is generally the same as or similar to the screw compressor 100 other than the modifications discussed below. Accordingly, aspects previously described will not be described in further detail. The screw compressor 350 includes rotor housing 115 having bores 120A, 120B.

To limit a duration of the pressure drop to the beginning of the suction phase 205 (see FIG. 5), a material 355 (e.g., a casting material or the like) can be added to a rotor bore surface. The material 355 can cause the pressure drop to be focused at a rotor pocket opening location (see FIG. 5). In an embodiment, the material 355 can be added to the rotor bores 120A, 120B after the screw compressor 350 has been manufactured. The material 355 can generally be the same material as the rotor housing 115. This can, for example, result in fewer changes to a manufacturing process for the screw compressor 350. In such an embodiment, the screw compressor 350 can be initially manufactured using current processes, and then the material 355 subsequently added to the screw compressor 350. In an embodiment, instead of adding material 355 after the bores 120A, 120B have been formed, the depth of the bores 120A, 120B may be modified, but current manufacturing tooling and processes would need modification accordingly.

The inlet port 360 is disposed within the material 355. In an embodiment, the inlet port 360 is fluidly connected to the evaporator 30 (FIG. 1) via lubricant return line 50 (FIG. 1). The inlet port 360 is configured such that lubricant pooling in the evaporator 30 is pulled from the evaporator 30 and provided to the trapped volume pockets (e.g., compression chamber 145 of FIG. 2) in a suction portion of the compression process. Thus a pressure in the compression chamber 145 at the location of the inlet port 360 is relatively lower than the pressure at the evaporator to induce flow of the lubricant to the screw compressor 350.

Figure 8:
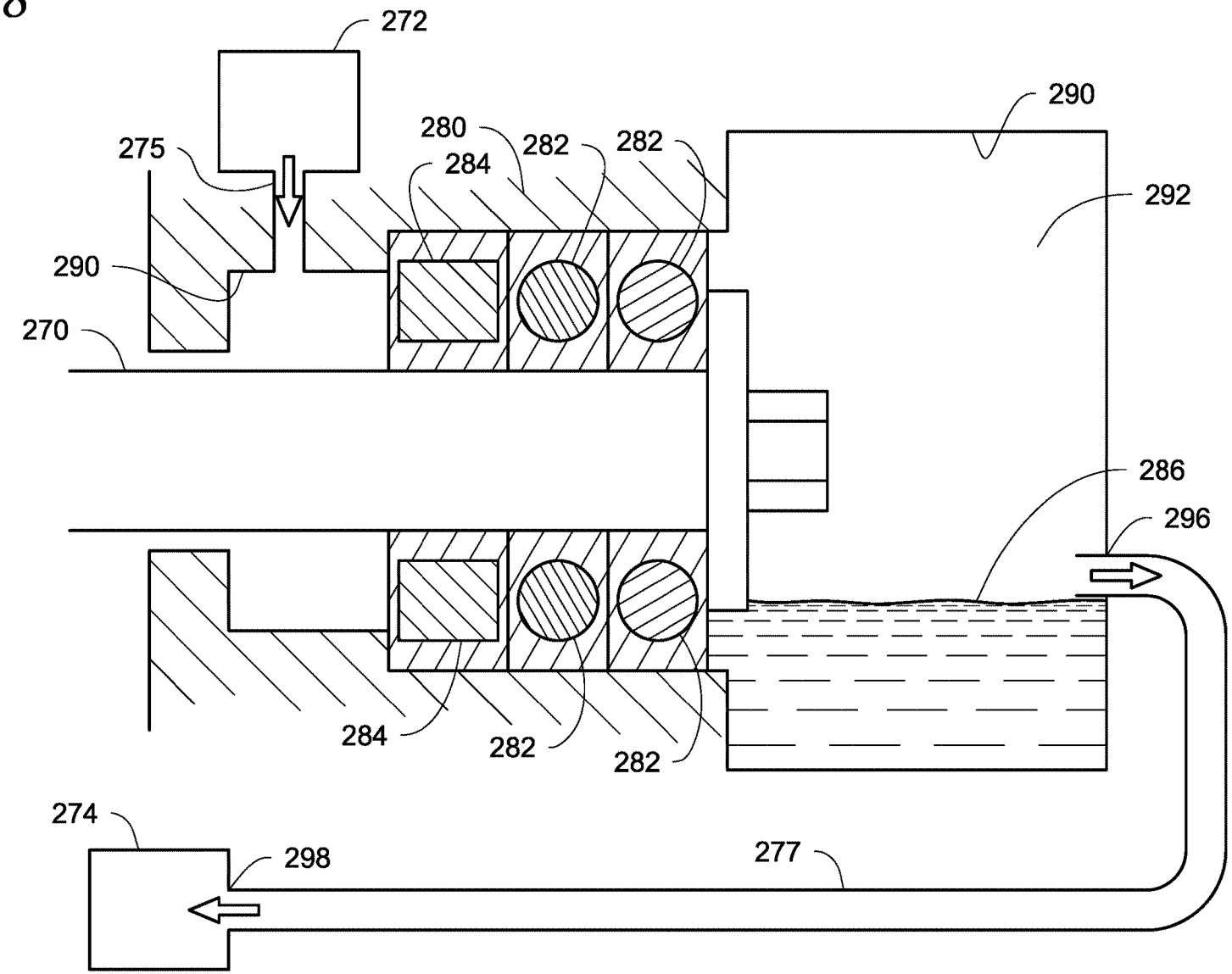
FIG. 8 shows a location for a lubricant inlet port, according to an embodiment.

FIG. 8 shows a location for a lubricant inlet port 275, according to an embodiment.

In an embodiment, the lubricant inlet port 275 is implemented in a sealed bearing cavity 290 of a compressor. In an embodiment, the compressor is a screw compressor, such as but not limited to the screw compressor 100 shown in FIG. 2. Using the screw compressor 100 of FIG. 2 as a reference, the first and second helical rotors 105, 110 include shafts on which the spiral lobes 125 and spiral grooves 130 are formed. See elongated members along each of axis A and axis B of FIG. 2, and through which each of axis A and axis B extend. These shafts are supported by bearings, such as for example one or more radial bearings and one or more thrust bearings.

FIG. 8 shows radial bearings 282 and thrust bearing 284. In an embodiment, the radial bearings 282 and thrust bearing 284 may be housed at least partially in a bearing housing 280. FIG. 2 also shows the bearing housing (not labeled), which covers the shafts on the left side of the rotors 105, 110, and to the left of the lobes 125 and grooves 130 as shown in FIG. 2. See hatched part going diagonal down from left to right covering the left of rotors 105, 110, which is the part where outlet 140 is located. The radial and thrust bearings 282, 284 support the left side of the shafts (each shown as a free end extending past the bearing housing on the left side of FIG. 2).

In FIG. 8, the thrust bearing 284, when compared to the radial bearings 282, would be relatively closer to the compression chamber 145 and to the lobes 125 and grooves 130 shown in FIG. 2. Thus, FIG. 8 shows a "flipped" view of the bearings where the left side (i.e. where thrust bearing 284 is located) would be closer to the compression chamber 145 in FIG. 2 than the right side of FIG. 8 (i.e. toward the direction of the radial bearings 282). FIG. 8 is a schematic sectional view of the bearings 282, 284 and of the sealed bearing cavity.

In FIG. 8, one shaft 270 is shown which is supported by the radial bearings 282 and thrust bearing 284. It will be appreciated that the shaft 270 can support either of the rotors 105, 110. It will be appreciated that separate shafts would support each of the rotors 105, 110, though one shaft is shown in FIG. 8. It will be appreciated that the shaft 270 and set of bearings 282, 284 may be implemented in the same or similar way for both rotors 105, 110.

In an embodiment, the lubricant inlet port 275 is located through the bearing housing 270, which is different from FIG. 2 where the lubricant inlet port 175 is located between the suction inlet port 135 and discharge outlet port 140.

The sealed bearing cavity 290 is at least partially housed by the bearing housing 280, as a bearing cover (not shown) may also house a part of the sealed bearing cavity 290. For example, the bearing cover may be on the right side of FIG. 8 and may be at the end of the compressor. In an embodiment, the sealed bearing cavity 290 can be fully housed within the bearing housing 280 without being housed by a bearing cover. It will be appreciated that in some embodiments, the sealed bearing cavity 290 may or may not be fully fluid tight seal, as there may be some leakage.

As shown in FIG. 8, included within the sealed bearing cavity 290 are the end of the shaft 270, the bearings 282, 284, and a volume 292.

The lubricant inlet port 275 is in fluid communication with the sealed bearing cavity 290. In an embodiment, the lubricant inlet port 275 includes a line that extends through the bearing housing 280. In an embodiment, a lubricant outlet line 277 extends from a lubricant outlet port 296 to an outlet 298 of the lubricant outlet line 277. The lubricant outlet port 296 allows lubricant to flow out of the volume 292 of the cavity 290 and through the outlet 298 of the lubricant outlet line 277.

In an embodiment, the lubricant inlet port 275 is supplied by another component 272 of the HVAC system. In an embodiment, the component 272 may be, but is not limited to an oil tank, oil separator, reservoir, or like. In an embodiment, the component 272 may be the evaporator (e.g. see FIG. 1).

Lubricant flows through the lubricant inlet port 275 into the sealed bearing cavity 290. The flow of lubricant may be based on pressure differential. In other embodiments, the flow of lubricant may be regulated flow and/or on/off modulated flow. In an embodiment, the flow of lubricant can be constant.

In an embodiment where the pressure differential drives the flow of lubricant, the lubricant outlet port 296 is fluidly connected to a lower pressure than the lubricant inlet port 275. In an embodiment, the lower pressure is lower than suction pressure, at which the lubricant inlet port may be according to some embodiments. In an embodiment, the outlet 298 of the lubricant outlet line 277 communicates with an inlet of a component 274 of the HVAC system which is at lower pressure than the lubricant inlet port 275. In an embodiment, the pressure within the cavity 290 may also be lower than the pressure through the lubricant inlet port 275.

In an embodiment, the pressure of the bearing cavity 290 is reduced, which may be useful to flash refrigerant from the lubricant, which can increase lubricant viscosity.

In an embodiment, the lubricant outlet port 296 is positioned at a height to create a volume or pool 286 of higher viscosity lubricant, which can help to lubricate the bearings 282, 284.

In an embodiment, FIG. 8 may be implemented in a circuit design as shown in FIG. 1. In an embodiment, an inlet end of the lubricant return line 50 is connected at a location of the evaporator 30 at which liquid lubricant may pool. The lubricant return line 50 has an outlet end connected to a location of the compressor 15 having a relatively lower pressure than the evaporator 30. Thus the pressure differential between the inlet end and the outlet end of the lubricant return line 50 functions to pull the lubricant pooling in the evaporator 30 from the evaporator 30 to the compressor 15. As a result, the lubricant may not be trapped in the evaporator 30, which can, for example, reduce a likelihood of a forced shutdown or premature failure of the compressor 15. In an embodiment, the pressure drop between the evaporator 30 and the compressor 15 may be relatively small to induce the flow. For example, the pressure drop can be at or about 1 to at or about 2 psi. In an embodiment, the pressure drop can be at or about 1 psi or less than 1 psi. It is to be appreciated that these values are examples and can vary beyond the stated range. In an embodiment, the outlet end of the lubricant return line 50 can be in communication with the lubricant inlet port 275, where the location of lubricant injection is the bearing cavity 290.

Aspects

It is noted that any of aspects 1-8 can be combined with any one of aspects 9-14 and 15-20. Any one of aspects 9-14 can be combined with any one of aspects 15-20.

Aspect 1. A heating, ventilation, air conditioning, and refrigeration (HVACR) system, comprising: a compressor including a lubricant inlet port, a condenser, and an evaporator fluidly connected to form a refrigerant circuit; and a lubricant return line fluidly connected to the compressor and to the evaporator, wherein a pressure difference between the compressor and the evaporator induces a fluid flow of lubricant from the evaporator to the compressor, a pressure at the lubricant inlet port being relatively lower than a pressure in the evaporator.

Aspect 2. The HVACR system of aspect 1, wherein the lubricant return line is fluidly connected to the lubricant inlet port, the lubricant inlet port being disposed between a suction inlet and a discharge outlet of the compressor.

Aspect 3. The HVACR system of aspect 2, wherein the lubricant inlet port is disposed relatively nearer to the suction inlet of the compressor than the discharge outlet.

Aspect 4. The HVACR system of any one of aspects 1-3, wherein the lubricant return line is fluidly connected to the lubricant inlet port formed in a portion of a housing of the compressor.

Aspect 5. The HVACR system of any one of aspects 1-4, wherein the lubricant inlet port is disposed at a location in fluid communication with a trapped volume pocket of the compressor.

Aspect 6. The HVACR system of aspect 5, wherein the trapped volume pocket is a compression chamber of the compressor.

Aspect 7. The HVACR system of any one of aspects 5 or 6, wherein the compressor is a screw compressor and the trapped volume pocket is a rotor pocket of the screw compressor.

Aspect 8. The HVACR system of any one of aspects 1 and 3 to 5, wherein the lubricant inlet port being in communication with a bearing cavity of the compressor.

Aspect 9. A lubricant management method for a compressor in a heating, ventilation, air conditioning, and refrigeration (HVACR) system, comprising: forming a lubricant inlet port in a location of a compressor of the HVACR system, the location being disposed between a suction inlet and a discharge outlet of the compressor; and fluidly connecting the lubricant inlet port and an evaporator in the HVACR system, wherein a pressure at the lubricant inlet port is relatively lower than a pressure in the evaporator.

Aspect 10. The method of aspect 9, wherein the lubricant inlet port is disposed relatively closer to the suction inlet than to the discharge outlet.

Aspect 11. The method of one of aspects 9 or 10, wherein the lubricant inlet port is formed in communication with a trapped volume pocket of the compressor.

Aspect 12. The method of aspect 11, wherein the trapped volume pocket of the compressor is a compression chamber of the compressor.

Aspect 13. The method of any one of aspects 11 or 12, wherein the compressor is a screw compressor and the trapped volume pocket is a rotor pocket of the screw compressor.

Aspect 14. The method of any one of aspects 9-13, wherein the forming the lubricant inlet port includes forming the lubricant inlet port in a portion of a housing of the compressor.

Aspect 15. A compressor for a heating, ventilation, air conditioning, and refrigeration (HVACR) system, comprising: a suction inlet that receives a working fluid to be compressed; a compression mechanism fluidly connected to the suction inlet that compresses the working fluid; a discharge outlet fluidly connected to the compression mechanism that outputs the working fluid following compression by the compression mechanism; and a lubricant inlet port disposed between the suction inlet and the discharge outlet at a location that is relatively closer to the suction inlet than the discharge outlet, the lubricant inlet port configured to be fluidly connected to an evaporator, wherein a pressure difference between the compressor and the evaporator is configured to induce a fluid flow of lubricant from the evaporator to the compressor, and a pressure at the lubricant inlet port is relatively lower than a pressure in the evaporator.

Aspect 16. The compressor of aspect 15, wherein the lubricant inlet port is formed in a portion of a rotor housing of the compressor.

Aspect 17. The compressor of one of aspects 15 or 16, wherein the lubricant inlet port is disposed at a location in fluid communication with a trapped volume pocket of the compressor.

Aspect 18. The compressor of aspect 17, wherein the trapped volume pocket is a compression pocket of the compressor.

Aspect 19. The compressor of any one of aspects 17 or 18, wherein the compressor is a screw compressor and the trapped volume pocket is a rotor pocket of the screw compressor.

Aspect 20. The compressor of any one of aspect 15, wherein the lubricant inlet port being in communication with a bearing cavity of the compressor.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A lubricant management method for a screw compressor in a heating, ventilation, air conditioning, and refrigeration (HVACR) system, comprising:

forming a lubricant inlet port in a location of the screw compressor of the HVACR system, and fluidly connecting the lubricant inlet port to be in fluid communication with a lubricant supplying component of the HVACR system by connecting an outlet end of a lubricant return line to the screw compressor and connecting an inlet end of the lubricant return line to the lubricant supplying component of the HVACR system, wherein the lubricant inlet port is disposed in a sealed bearing cavity of the screw compressor, wherein the sealed bearing cavity is at least partially housed by a bearing housing, a lubricant pool is formed in the sealed bearing cavity, wherein a lubricant outlet port of the sealed bearing cavity is fluidly connected to a component of the HVACR system having a lower pressure than a first pressure at the lubricant inlet port such that a second pressure in the sealed bearing cavity is lower than the first pressure at the lubricant inlet port.

2. The method of claim 1, further comprising flashing refrigerant in the lubricant by having the second pressure in the sealed bearing cavity being lower than the first pressure at the lubricant inlet port to increase viscosity of the lubricant.

3. The method of claim 1, wherein the sealed bearing cavity is configured such that the lubricant outlet port is positioned at a height to create a volume of lubricant to lubricate radial and thrust bearings of the screw compressor.

4. A heating, ventilation, air conditioning, and refrigeration (HVACR) system, comprising:

a screw compressor including a lubricant inlet port;

a condenser;

an evaporator fluidly connected to form a refrigerant circuit; and a lubricant return line connected at an outlet end to the lubricant inlet port of the screw compressor and connected at an inlet end to a liquid level in a lubricant supplying component of the HVACR system, wherein the lubricant inlet port is disposed in a sealed bearing cavity of the screw compressor, wherein the sealed bearing cavity is at least partially housed by a bearing housing, the sealed bearing cavity includes a lubricant pool, wherein a lubricant outlet port of the sealed bearing cavity is fluidly connected to a component of the HVACR system having a lower pressure than a first pressure at the lubricant inlet port such that a second pressure in the sealed bearing cavity is lower than the first pressure at the lubricant inlet port.

5. The HVACR system of claim 4, wherein the second pressure in the sealed bearing cavity is lower than the first pressure at the lubricant inlet port such that refrigerant in the lubricant is flashed to increase viscosity of the lubricant.

6. The HVACR system of claim 4, wherein the sealed bearing cavity is configured such that the lubricant outlet port is positioned at a height to create a volume of lubricant to lubricate radial and thrust bearings of the screw compressor.

7. The HVACR system of claim 4, wherein the lubricant inlet port includes a line that extends through the bearing housing.

8. The HVACR system of claim 4, wherein an end of a shaft, at least one radial bearing, a thrust bearing, and the lubricant pool are included within the sealed bearing cavity, the at least one radial bearing and the thrust bearing are housed at least partially in the bearing housing.

9. The HVACR system of claim 8, wherein the thrust bearing, when compared to the at least one radial bearing, is relatively closer to a compression chamber of the screw compressor.

10. The HVACR system of claim 8, wherein the lubricant outlet port is positioned at a height to create the lubricant pool to lubricate the at least one radial bearing and the thrust bearing, the lubricant outlet port is disposed higher than the lubricant pool.

11. The HVACR system of claim 10, wherein a lubricant outlet line extends from the lubricant outlet port to an outlet of the lubricant outlet line.

* * * * *